US010597975B2

(12) United States Patent
Vasques et al.

(10) Patent No.: US 10,597,975 B2
(45) Date of Patent: Mar. 24, 2020

(54) DOWNHOLE COMPLETION SYSTEM

(71) Applicant: Welltec Oilfield Solutions AG, Zug (CH)

(72) Inventors: Ricardo Reves Vasques, Allerød (DK); Paul Hazel, Aberdeen (GB)

(73) Assignee: Welltec Oilfield Solutions AG, Zug (CH)

( * ) Notice: Subject to any disclaimer, the term of this patent is extended or adjusted under 35 U.S.C. 154(b) by 51 days.

(21) Appl. No.: 15/529,716

(22) PCT Filed: Dec. 1, 2015

(86) PCT No.: PCT/EP2015/078213

§ 371 (c)(1),
(2) Date: May 25, 2017

(87) PCT Pub. No.: WO2016/087441

PCT Pub. Date: Jun. 9, 2016

(65) Prior Publication Data

US 2017/0328173 A1 Nov. 16, 2017

(30) Foreign Application Priority Data

Dec. 1, 2014 (EP) ..... 14195722

(51) Int. Cl.
*E21B 34/14* (2006.01)
*E21B 23/04* (2006.01)
(Continued)

(52) U.S. Cl.
CPC ..... *E21B 34/14* (2013.01); *E21B 23/04* (2013.01); *E21B 34/066* (2013.01); *E21B 23/06* (2013.01);
(Continued)

(58) Field of Classification Search
CPC ..... E21B 34/14; E21B 34/066; E21B 23/04; E21B 23/06; E21B 33/1285; E21B 2034/007
See application file for complete search history.

(56) References Cited

U.S. PATENT DOCUMENTS

2013/0240197 A1* 9/2013 Hallundbæk et al. .. E21B 23/00 166/66.4
2014/0238666 A1* 8/2014 Walton ..... E21B 47/122 166/250.01
2015/0176369 A1* 6/2015 Nguyen ..... E21B 34/066 166/308.1

FOREIGN PATENT DOCUMENTS

WO WO 2013/079929 6/2013
WO WO 2013/150304 10/2013
WO WO 2014/065813 5/2014

OTHER PUBLICATIONS

International Search Report and Written Opinion of the ISA for PCT/EP2015/078213, dated Feb. 2, 2016, 11 pages.
Search Report for 14195722.5, dated Jun. 9, 2015, 4 pages.

* cited by examiner

*Primary Examiner* — David J Bagnell
*Assistant Examiner* — Yanick A Akaragwe
(74) *Attorney, Agent, or Firm* — Nixon & Vanderhye P.C.

(57) ABSTRACT

Downhole completion system (100) arranged in a borehole, comprising a production casing (2) having an axial extension with an opening (4) for providing fluid communication between the borehole and the inside of the casing, a sleeve (5) arranged at least partly movably along or rotatably around the axial extension for opening, choking or closing the fluid communication and a sleeve control (7) for moving the sleeve (5) to open, choke or close the opening (4), wherein the sleeve control comprises a first part having at least one member (9) engaging the profile, a second part
(Continued)

having a fixation unit (11) fixating the sleeve control in the casing, an actuator (12) for moving the first part in relation to the second part, a power supply (14), such as a battery, supplying power to the actuator (12), and a first communication module (15) for receiving control signals from surface.

17 Claims, 11 Drawing Sheets

(51) Int. Cl.

| | |
|---|---|
| ***E21B 34/06*** | (2006.01) |
| *E21B 23/06* | (2006.01) |
| *E21B 33/128* | (2006.01) |
| *E21B 34/00* | (2006.01) |

(52) U.S. Cl.
CPC ..... *E21B 33/1285* (2013.01); *E21B 2034/007* (2013.01)

DOWNHOLE COMPLETION SYSTEM

This application is the U.S. national phase of International Application No. PCT/EP2015/078213 filed 1 Dec. 2015, which designated the U.S. and claims priority to EP Patent Application No. 14195722.5 filed 1 Dec. 2014, the entire contents of each of which are hereby incorporated by reference.

FIELD OF THE INVENTION

The present invention relates to a downhole completion system arranged in a borehole. The downhole completion system comprises a production casing having an axial extension, an inside, an inner diameter and an opening for providing fluid communication between the borehole and the inside. A sleeve or a completion component is arranged at least partly movably along or rotatably around the axial extension, the sleeve or the completion component being arranged opposite the opening for opening, choking or closing the fluid communication, the sleeve having a profile facing the inside of the casing, and a sleeve control for moving the sleeve to open, choke or close the opening.

BACKGROUND ART

In recent years, there has been a focus on designing oil or gas wells so complex that it is possible to control the components, such as valves, from surface without having to intervene the well by means of intervention tools. In order to control the components from surface, the completion has been equipped with control lines extending from surface all the way down to the components several kilometres down the well on the outside of the production casing. However, the control lines thus have to extend past the main barriers, which induces a substantial risk of leaking barriers and thus the possibility of blowouts.

To prevent having control lines, some wells have been developed with a much simpler design without control lines. These wells of a more simple design are much quicker to complete, meaning that substantial rig time is saved. In order to adjust e.g. the valves of wells having such simple well design, intervention tools are used. However, some operators still want to have wells completed without the use of intervention tools.

SUMMARY OF THE INVENTION

It is an object of the present invention to wholly or partly overcome the above disadvantages and drawbacks of the prior art. More specifically, it is an object to provide an improved completion system without penetrating the primary barrier in the form of the main barriers or the main casing but still with the possibility of operating e.g. the valves from surface.

The above objects, together with numerous other objects, advantages and features, which will become evident from the below description, are accomplished by a solution in accordance with the present invention by a downhole completion system arranged in a borehole, comprising:

- a production casing having an axial extension, an inside, an inner diameter and an opening for providing fluid communication between the borehole and the inside,
- a sleeve or a completion component arranged at least partly movably along or rotatably around the axial extension, the sleeve or the completion component being arranged opposite the opening for opening, choking or closing the fluid communication, the sleeve having a profile facing the inside of the casing, and
- a sleeve control for moving the sleeve to open, choke or close the opening, wherein the sleeve control comprises:
  - a first part having at least one member engaging the profile,
  - a second part having:
    - a fixation unit fixating the sleeve control in the casing,
    - an actuator for moving the first part in relation to the second part,
    - a power supply, such as a battery, supplying power to the actuator, and
    - a first communication module for receiving control signals from surface.

The downhole completion system arranged in a borehole may comprise:

- a production casing having an axial extension, an inside, an inner diameter, and an opening for providing fluid communication from the borehole past the opening,
- a completion component for opening, choking or closing the fluid communication, the completion component having a profile facing the inside of the casing, and
- a component control for opening, choking or closing the opening, wherein the component control comprises:
  - a first part having a member engaging the profile,
  - a second part having:
    - a fixation unit fixating the sleeve control in the casing,
    - an actuator for moving the first part in relation to the second part,
    - a power supply, such as a battery, supplying power to the actuator, and
- a first communication module for receiving control signals from surface.

By having a permanently installed sleeve control or component control in the production casing, the sleeve control or component control communicates with surface with simple command signals to operate the valves without having to penetrate the primary barrier, i.e. the packer between the intermediate casing and the production casing, by means of control lines or the main casing itself.

By the primary barrier is meant the intermediate casing, the main barrier, i.e. the main packer, and the main production casing, i.e. the production casing, when the completion is not a double skin casing/completion. In the event that the completion is a double skin, by primary barrier is meant the intermediate casing, the main barrier, i.e. the main packer, and the main production casing, i.e. the outermost production casing.

The downhole completion system as described above may further comprise a second communication module for communicating with the first communication module.

If communication to the sleeve control or component control is insufficient, second communication modules may be arranged in or nearby the casing collars functioning as nodes, or second communication modules may be submerged into the annulus above the main barrier packer.

Further, the second communication module may comprise a first communication unit and a second communication unit.

Moreover, the first communication unit and the second communication unit may be electrically connected via electromagnetic induction.

The first communication unit may be arranged on an outer face of the casing and the second communication unit is arranged on an inner face of the casing.

Further, the second communication module may comprise a third communication unit connected with the second communication unit by means of wiring or a conductor, such as a cable, a cord or a wire.

Also, a first part of the completion component may be the at least one member engaging the profile of a second part of the completion component.

Moreover, the second communication module may be arranged near a top of the borehole, submerged into an annulus between the production casing and a wall of the borehole or an intermediate casing, or connected to the production casing.

Further, the first and second communication modules may communicate wirelessly by means of mud pulses, an electrical field, electromagnetic induction or acoustic waves.

Also, the power supply may be rechargeable.

For instance, the power supply may be recharged by the first communication module converting the mud pulses, an electrical field or acoustic waves into electrical energy.

Furthermore, the production casing may comprise annular barriers, each annular barrier comprising:

- a tubular part adapted to be mounted as part of the production casing, the tubular part having an outer face and an inside,
- an expandable sleeve surrounding the tubular part and having an inner sleeve face facing the tubular part and an outer sleeve face facing the wall of the borehole, each end of the expandable sleeve being connected with the tubular part,
- an annular space between the inner sleeve face of the expandable sleeve and the tubular part, and
- a first opening tubular part in fluid communication with the annular space.

Moreover, the fixation unit may have fixation elements extending radially towards the production casing.

The production casing may comprise a restriction for fixating the fixation unit.

Also, the sleeve control may comprise a plurality of fixation units.

Additionally, the first communication module may comprise a propeller in connection with a generator for recharging the power supply by converting rotational energy generated by fluid in the production casing to electrical energy.

Further, the actuator may comprise an electrical motor powered by the power supply.

In addition, the actuator may comprise a gear arrangement driven by the motor for moving the first part.

Also, the gear arrangement may be a worm drive providing an axial movement of the first part in relation to the second part.

Said gear arrangement may comprise at least one gear wheel for rotating the first part in relation to the second part.

Moreover, the actuator may further comprise a cylinder having a cylinder chamber in which a first end of a cylinder shaft is arranged, a plunger connected to the shaft divides the chamber into a first chamber part and a second chamber part, a second end of the cylinder shaft is connected with the first part, the actuator further comprising a pump providing pressurised fluid into one of the chamber parts for moving the cylinder shaft and the first part along the axial extension.

The downhole completion system as described above may comprise a plurality of openings in the production casing, a plurality of sleeves arranged opposite the openings and a plurality of sleeve controls, each sleeve control being arranged opposite a sleeve for opening, choking or closing the fluid communication through the opening.

Furthermore, the first communication modules of the sleeve controls may communicate with each other.

Also, the sleeve controls may be connected to each other via a shaft or a wireline.

Further, the sleeve control may have a cross-sectional area which is at least 50% smaller than a cross-sectional area of the inside of the casing in a radial direction of the casing, preferably at least 45% smaller than the cross-sectional area of the inside of the casing, more preferably at least 35% smaller than the cross-sectional area of the inside of the casing.

The production casing may comprise a lateral.

Moreover, the lateral may comprise a sleeve and a sleeve control.

In addition, the lateral may comprise a completion component and a component control.

Furthermore, the first communication modules of the component controls may communicate with each other.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
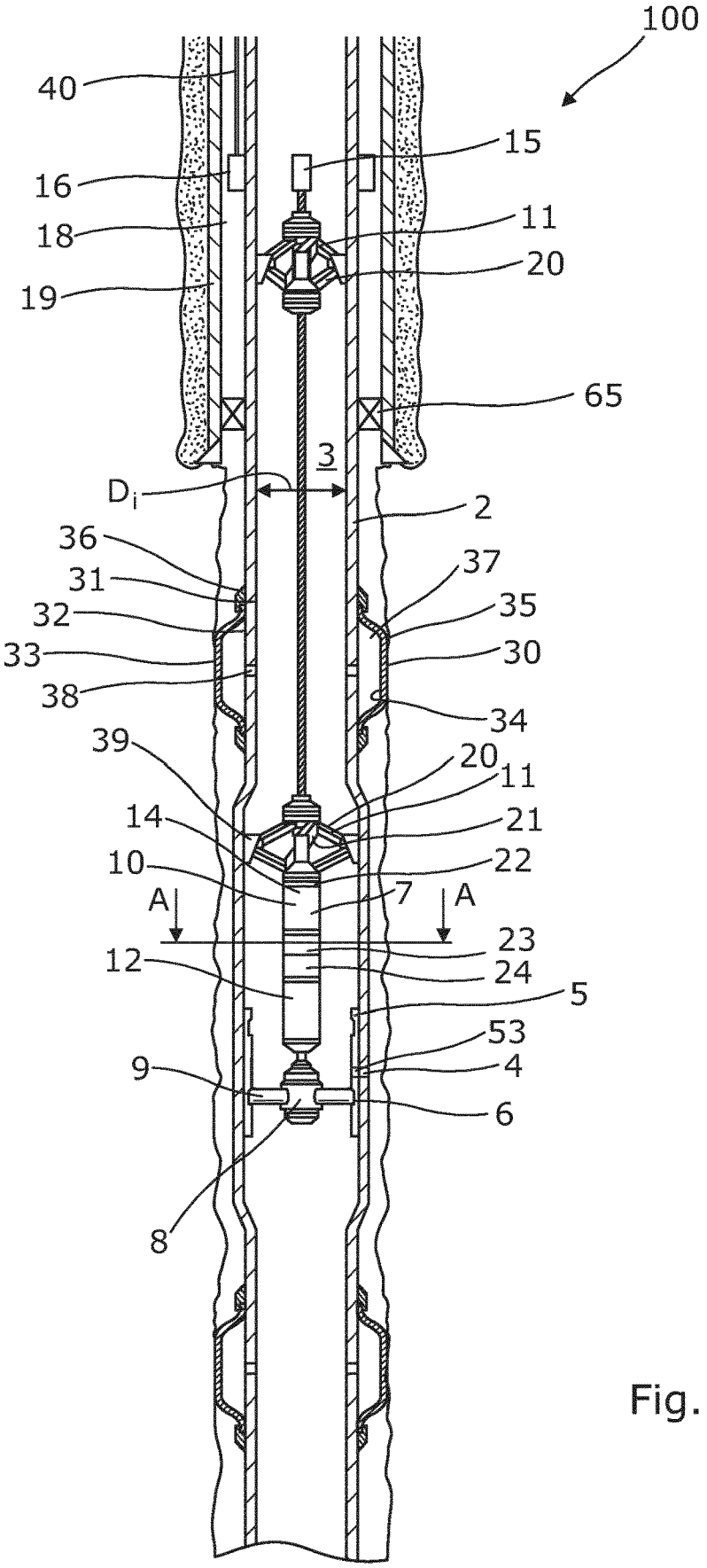
FIG. 1 shows a cross-sectional view of a downhole completion system having a sleeve control with two fixation units.

FIG. 1 shows a downhole completion system 100 arranged in a borehole and comprising a production casing 2 having an axial extension, an inside 3 in which fluid flows for producing oil or gas. The production casing has an inner diameter $D_i$ and an opening for providing fluid communication between the borehole and the inside and allowing fluid from the formation and into the casing. The downhole completion system comprises a sleeve 5 movable along or rotatable around the axial extension. The sleeve is arranged opposite the opening for opening, choking or closing the fluid communication from the reservoir. The sleeve has a profile 6 facing the inside of the casing. The downhole completion system further comprises a sleeve control 7 for moving the sleeve to open, choke or close the fluid communication.

The sleeve control 7 comprises a first part 8 having members 9 engaging the profile, and a second part 10 having a fixation unit 11 fixating the sleeve control in the casing. The sleeve control 7 comprises an actuator 12 for moving the first part 8 in relation to the second part 10, and a power supply 14, such as a battery, supplying power to the actuator. The sleeve control 7 further comprises a first communication module 15 for receiving control signals from surface to open, choke or close fluid communication. The sleeve control 7 is thus permanently installed in the production casing 2, ready to move the sleeve from one position to another in order to choke, open or close fluid communication from the reservoir. The sleeve control 7 has its own power supply and can operate on its own when receiving a control signal during production of fluid from the reservoir, without the well being intervened by commonly used intervention tools or having control lines penetrate the main barriers 65.

Figure 5:
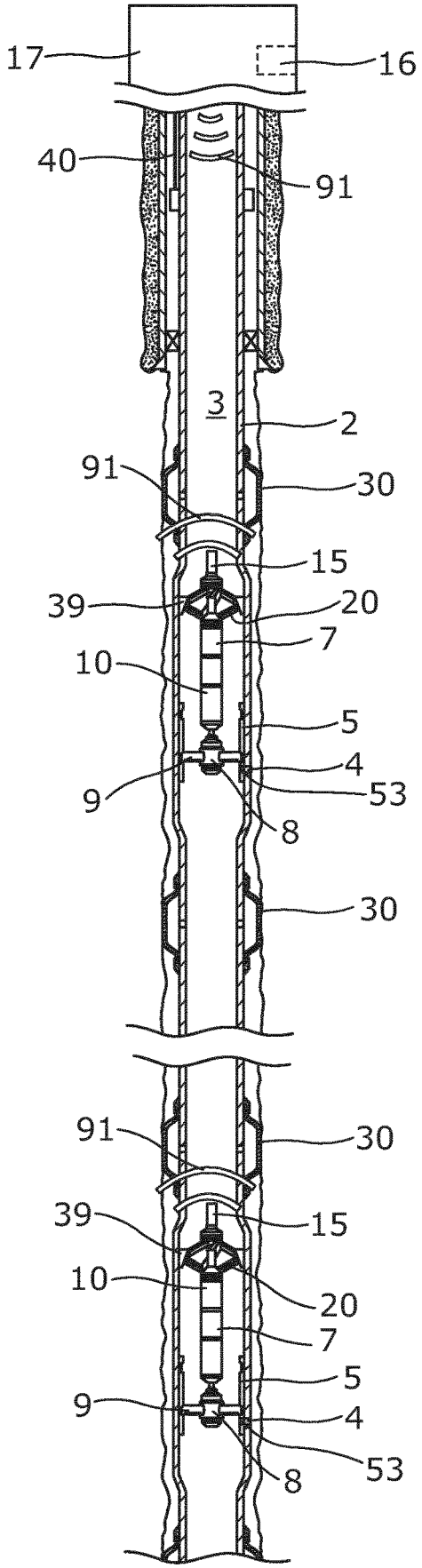
FIG. 5 shows a cross-sectional view of another downhole completion system having two separate sleeve controls.

The downhole completion system 100 further comprises a second communication module 16 for communicating with the first communication module 15. The second communication module 16 is submerged into an annulus 18 between the production casing 2 and a wall of an intermediate casing 19. In this way, the second communication module 16 can be lowered down the casing to a point above the packer 65 between the intermediate casing 19 and the production casing 2, so that the wiring 40 from the second communication module does not jeopardize the primary seal 65 of the well, and the second communication module 16 is also closer to the first communication module 15 than if the second communication module 16 was arranged at the top 17 of the well, as shown in FIG. 5. The second communication module may also be connected to the production casing 2 before being lowered into the borehole as shown at the right side of FIG. 1.

The first and the second communication modules 15, 16 communicate wirelessly by means of mud pulses, an electrical field or acoustic waves, as illustrated by curved lines 91 in the drawings. The communication may be performed by means of induction between induction means in the first and the second communication modules. The first communication module is therefore capable of receiving control signals from surface and power for recharging the power supply. Furthermore, the first communication module is capable of sending signals or even data to the second communication module, e.g. data from a sensor arranged near the sleeve or the completion control.

The second communication module 16 communicates through the wireline or through an umbilical to a control centre (not shown). Thus, when a decision to close, open or choke fluid from a certain production zone is made, a control signal is sent from the second communication module 16 to the first communication module 15 of the sleeve control which then actuates the sleeve to move and thereby close, open or choke fluid from that certain production zone. The sleeve is rotated or slid axially by the actuator which is powered by the on-board power supply.

The power supply is rechargeable and is recharged by the first communication module converting the mud pulses, an electrical field or acoustic waves into electrical energy. The first communication module may also comprise a propeller 21 in connection with a generator 22 for recharging the power supply by converting rotational energy generated by fluid in the production casing 2 into electrical energy, as shown in FIG. 1.

Figure 2:
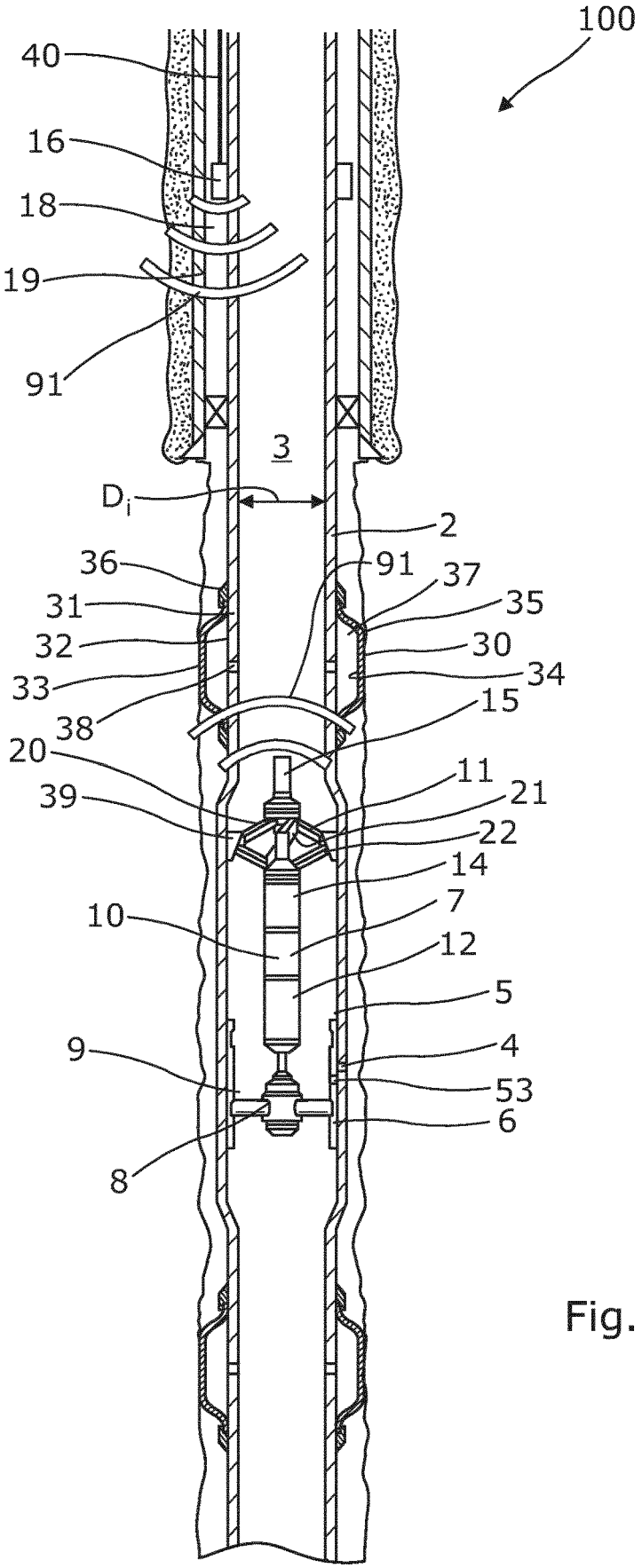
FIG. 2 shows a cross-sectional view of a downhole completion system having a sleeve control with one fixation unit.
Figure 11:
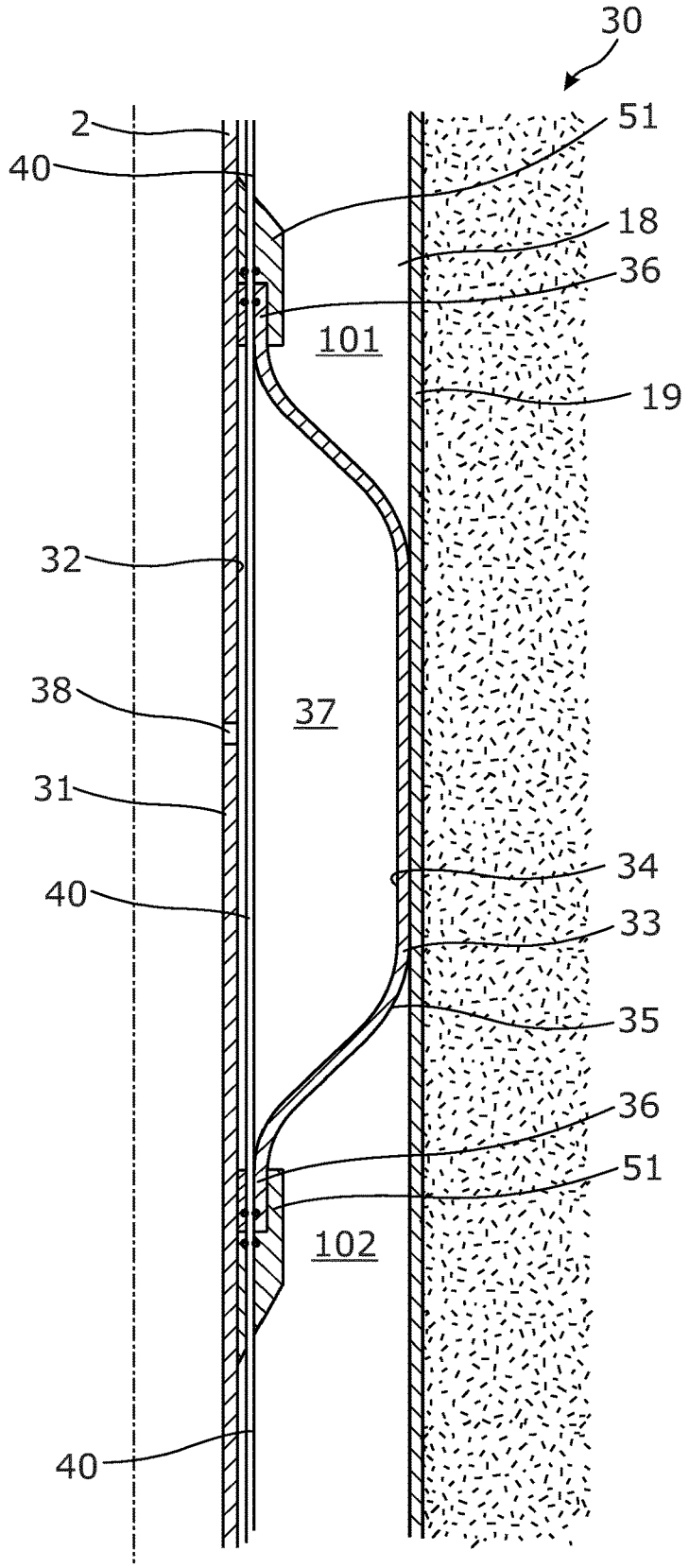
FIG. 11 shows a cross-sectional view of an annular barrier having wiring extending past the annular barrier in its space.

As shown in FIGS. 1 and 2, the production casing 2 comprises annular barriers 30 to isolate a production zone 101 (shown in FIG. 11) e.g. from a water zone or from another production zone 102 (shown in FIG. 11). Each annular barrier comprises a tubular part 31 adapted to be mounted as part of the production casing 2, and an expandable sleeve 33 surrounding the tubular part and having an inner sleeve face 34 facing the outer face 32 of the tubular part and an outer sleeve face 35 facing the wall of the borehole. Each end 36 of the expandable sleeve is connected with the tubular part by means of connection parts 51 (shown in FIG. 11) defining an annular space 37 between the inner sleeve face of the expandable sleeve and the tubular part. The tubular part has a first opening 38 in fluid communication with the annular space, so that pressurised fluid inside the casing can flow through the tubular part to expand the sleeve. A valve, such as a two-way valve or a three-way valve, may be arranged in one of the connection parts for controlling the passage of fluid in and out of the space to either inside the casing through the first opening or to the annulus surrounding the expandable sleeve. The tubular part and the expandable sleeve may be made of metal. The expandable sleeve may have sealing elements abutting its outer face.

As shown in FIGS. 1-5, the fixation unit of the sleeve control has fixation elements 20 extending radially towards the production casing and fixating the sleeve control in the production casing. In FIG. 1, the production casing 2 comprises a restriction 39 for fixating the fixation unit, and the sleeve control comprises two fixation units 11, each being fixated in restrictions spaced apart in the completion system. The fixation units 11 are connected with each other by means of a threaded shaft, so that both fixation units are fastened inside the casing by rotating the shaft, thereby forcing the fixation elements 20 radially outwards to engage the production casing.

In FIG. 2, the sleeve control has only one fixation unit 11 fastened in the restriction in the casing. The sleeve control is arranged in a section of the production casing 2 in which the inner diameter of the production casing is larger than in other sections of the production casing. In this way, the production fluid can pass the sleeve control more easily during production.

In FIG. 1, the actuator comprises an electrical motor 23 powered by the power supply and a gear arrangement 24 driven by the motor for moving the first part. The gear arrangement may be a worm drive providing an axial movement of the first part in relation to the second part by rotating a worm shaft of the worm drive and translating the rotational movement of the motor into a movement along the axial extension. In another embodiment, the gear arrangement comprises at least one gear wheel for rotating the first part in relation to the second part, and in this way the rotation of the motor is translated into a rotation of the sleeve, causing the opening to be opened, choked or closed. In FIG. 2, the fluid communication is closed due to the opening being covered by the wall of the sliding sleeve. In FIG. 1, the sleeve has an aperture 53 being aligned with the opening in the production casing 2 and the sleeve is thus in its open position.

Figure 6:
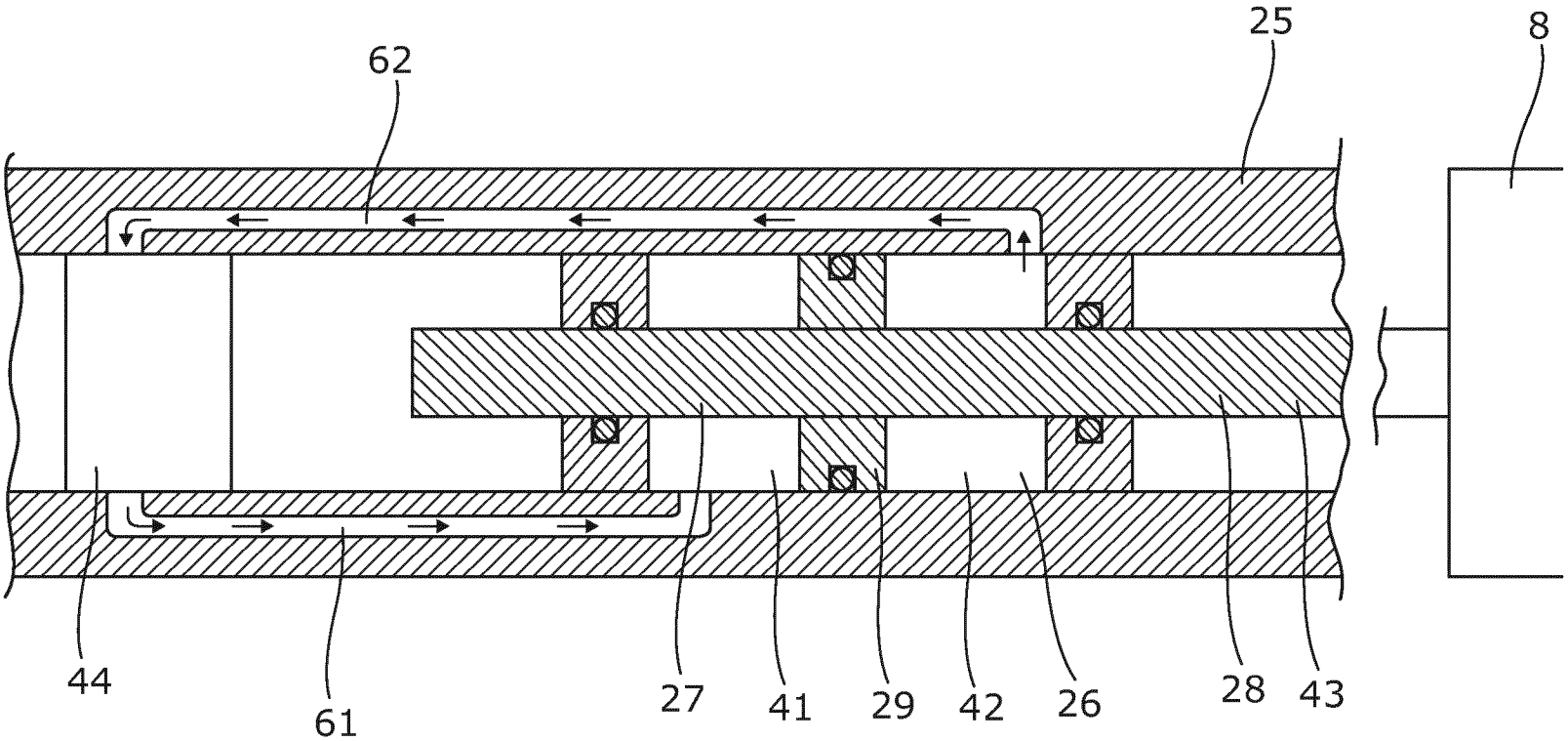
FIG. 6 shows a cross-sectional view of a sleeve control with a hydraulic actuator.

In FIG. 6, the actuator comprises a cylinder 25, such as a hydraulic cylinder, having a cylinder chamber 26 in which a first end 27 of a cylinder shaft 28 is arranged and a second end 43 of the cylinder shaft is connected with the first part 8. A plunger 29 is arranged around the shaft, dividing the chamber into a first chamber part 41 and a second chamber part 42. The actuator further comprises a pump 44 providing pressurised fluid into one of the chamber parts through a first channel 61 for moving the cylinder shaft and the first part along the axial extension. The pump may pump fluid into the first chamber part 41 and simultaneously suck fluid out of the second chamber part 42 through a second channel 62. In this way, the shaft and the first part 8 are moved in a first direction away from the actuator, and by providing pressurised fluid in the second channel and thus into the second chamber part, the shaft is moved in a second direction opposite the first direction. As can be seen, the plunger may be part of the shaft. In another cylinder, the housing comprises the plunger and is the moving part and the shaft is the stationary part.

Figure 3:
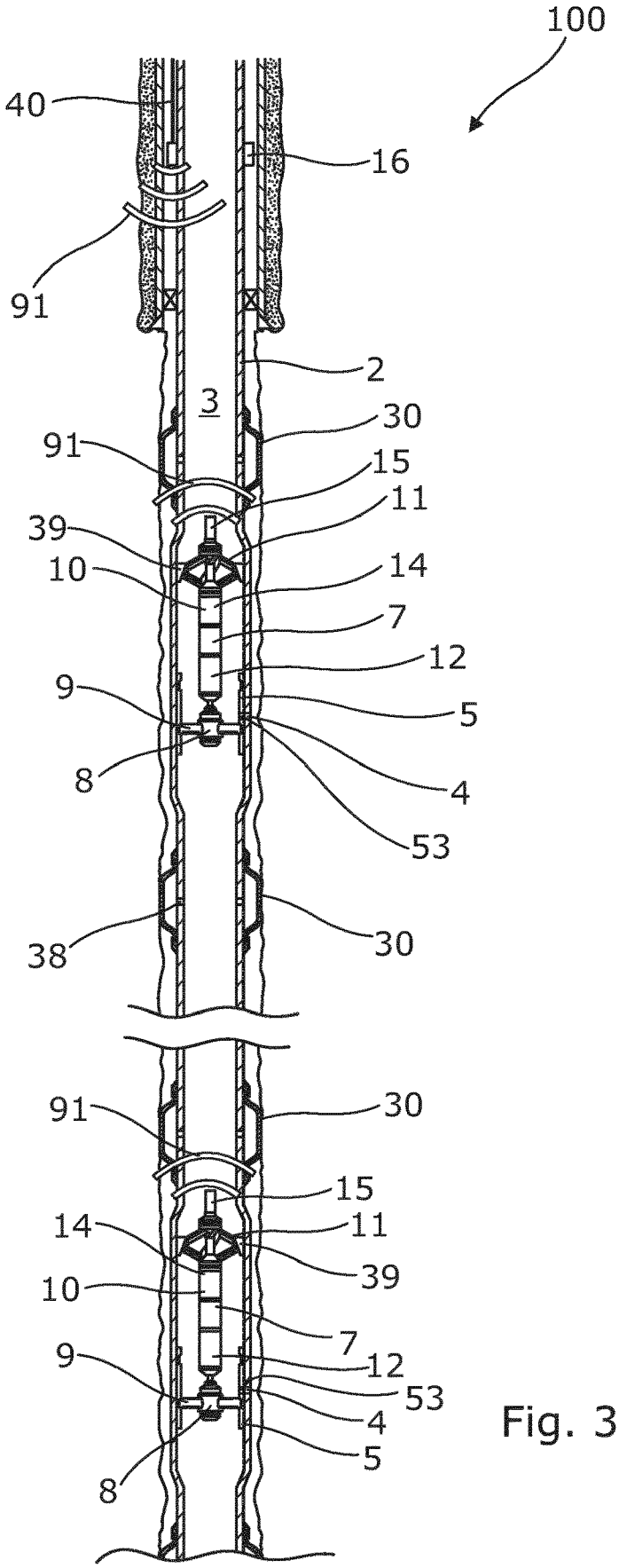
FIG. 3 shows a cross-sectional view of a downhole completion system having two separate sleeve controls.
Figure 4:
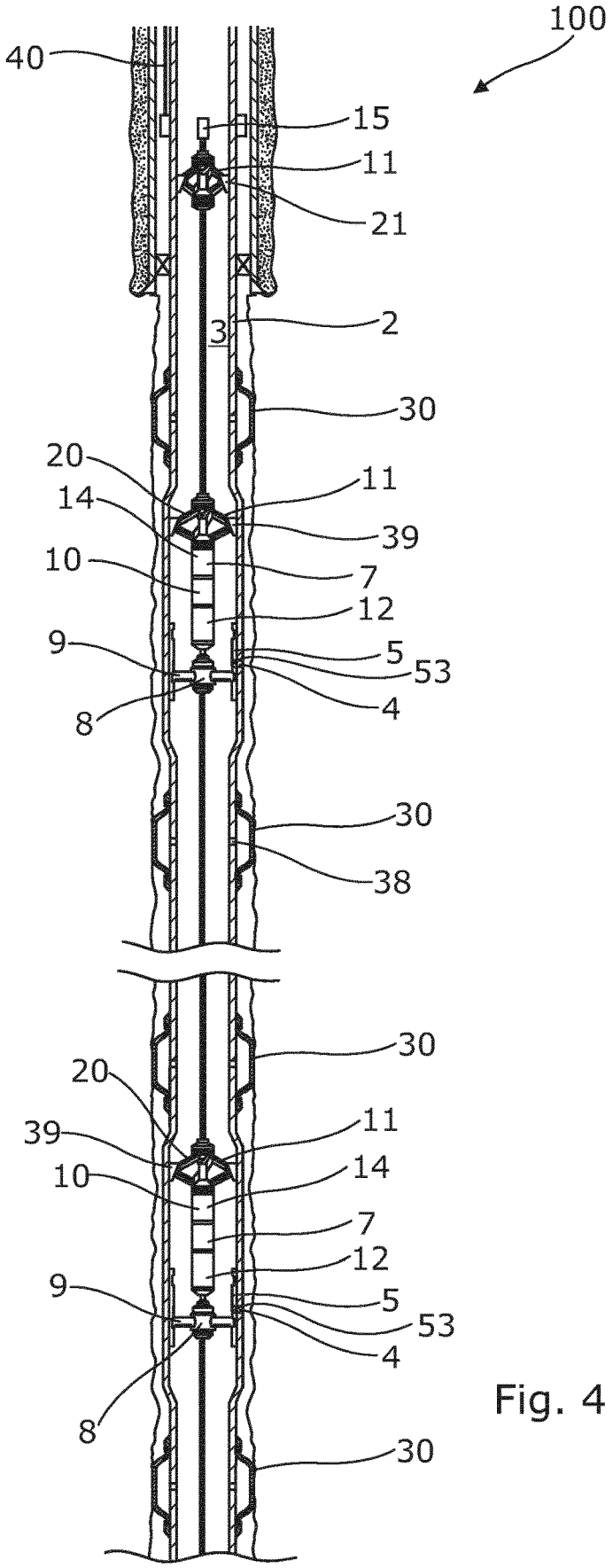
FIG. 4 shows a cross-sectional view of a downhole completion system having two sleeve controls being connected by a shaft.

In FIG. 3, the downhole completion system comprises a plurality of openings in the production casing 2, a plurality of sleeves arranged opposite the openings and a plurality of sleeve controls 7, each sleeve control being arranged opposite a sleeve for opening, choking or closing the fluid communication through the opening. The sleeve controls 7 are not connected with each other and are only communicating wirelessly with each other, so that once the first sleeve control arranged nearest the top of the well receives a control signal to the next sleeve control arranged further down the production casing, the first sleeve control passes the signal on and the first communication module of the first sleeve control is thus used as a communication point. In FIG. 4, the downhole completion system comprises two sleeve controls 7 fastened to each other by means of a threaded shaft and a wireline/umbilical, so that the first communication module of the first sleeve control arranged nearest the top of the well communicates wirelessly to the second communication module, and the first communication module communicates to sleeve controls further down the well by means of the wireline/umbilical. The threaded shaft makes it possible to set and release all sleeve controls in one movement.

Figure 7:
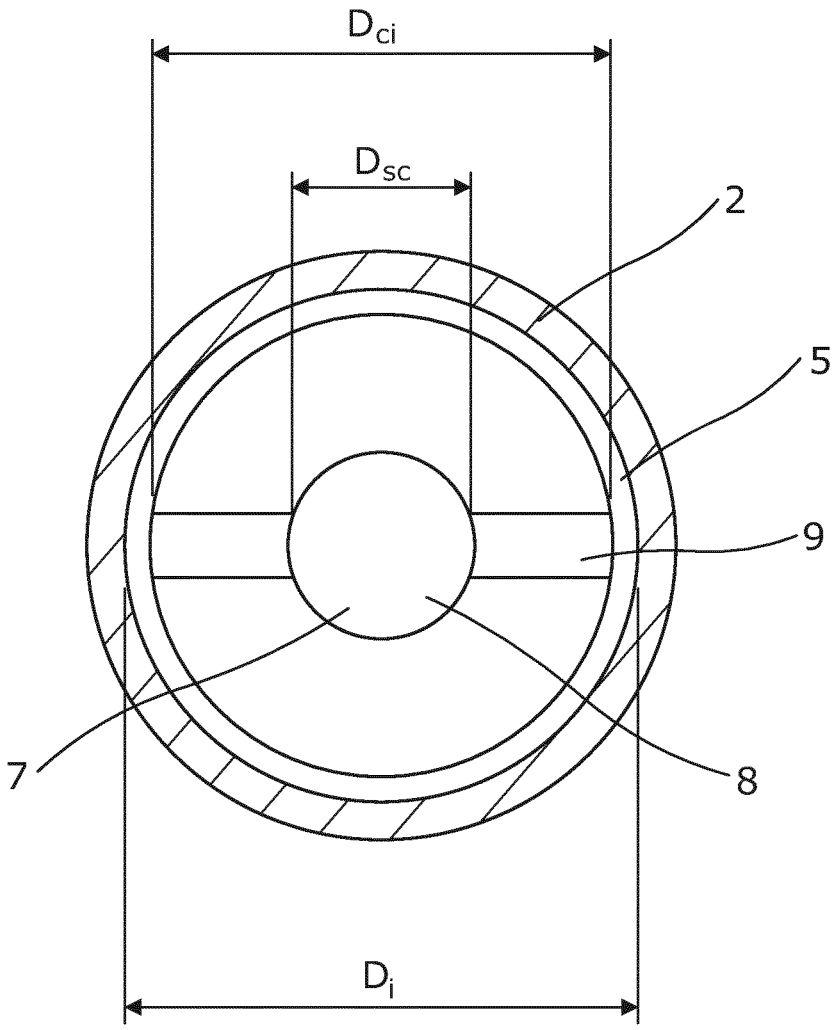
FIG. 7 shows a cross-sectional view of the production casing and the sleeve control arranged therein when seen along the axial extension.

FIG. 7 shows a cross-sectional view of the production casing 2 and the sleeve control 7 arranged therein when seen along the axial extension. The sleeve control 7 has a cross-sectional area $D_{sc}$ in a radial direction of the casing 2, which area is at least 50% smaller than a cross-sectional area $D_{ci}$ of the inside of the casing, preferably at least 45% smaller than the cross-sectional area of the inside of the casing, more preferably at least 35% smaller than the cross-sectional area of the inside of the casing. The smallest cross-sectional area $D_{ci}$ of the inside of the casing is, in this embodiment, the inside of the sleeve. Though not shown, the sleeve may be arranged in a circumferential recess in the casing, and then the smallest cross-sectional area $D_{ci}$ of the inside of the casing is the inner diameter of the casing.

Figure 8:
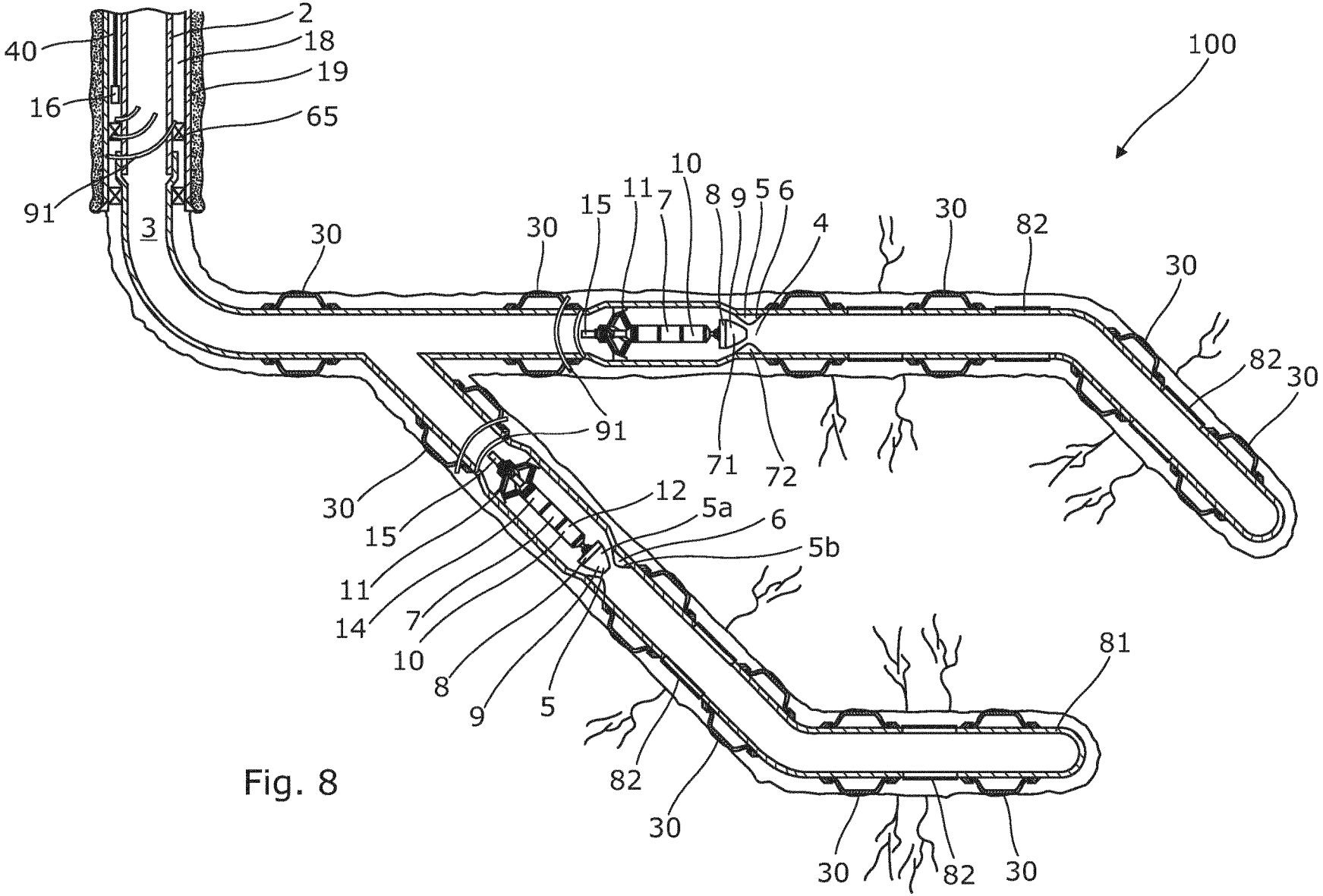
FIG. 8 shows a cross-sectional view of a production casing having a lateral with a completion control.

In FIG. 8, the downhole completion system 100 arranged in a borehole comprises a production casing 2 having an opening 4 for providing fluid communication from the borehole past the opening. The opening 4 is arranged inside the casing as a seat restricting the inner diameter of the casing. The downhole completion system 100 comprises, instead of a sleeve, a completion component 5 for opening, choking or closing the fluid communication. The completion component 5 has a profile 6 facing the inside of the casing. The downhole completion system 100 further comprises a component control 7 for opening, choking or closing the opening. The component control 7 comprises a first part 8 having a member 9 engaging the profile 6, and a second part 10. The second part 10 comprises a fixation unit 11 fixating the sleeve control 7 in the casing, an actuator 12 for moving the first part in relation to the second part, a power supply 14, such as a battery, supplying power to the actuator, and a first communication module 15 for receiving control signals from surface. The first part 8 has a conical part 71 matching the seat part 72 of the component 5, and when the first part is moved axially, the conical part 71 seats in the seat part 72 to close the opening 4. As can be seen, the production casing 2 has a main production casing and a lateral production casing 81. The main production casing and the lateral production casing 81 both have an inflow control valve 82, and closer to the top the component controls 7 are arranged, so that fluid from the lower part of the production casings can be choked if not closed off.

As can be seen in FIG. 8, the lateral production casing 81 has the same size, i.e. the same inner diameter, as the main production casing 2, meaning that the lateral has the same inner diameter as the rest of the production casing. Hence, the lateral is a full bore lateral. Both the lateral and the main production casing have annular barriers 30 isolating several production zones, so that each zone is isolated between two adjacent annular barriers. Between the two annular barriers an inflow control valve 82 is arranged. The valves may include a fracturing port. If one production zone is producing too much water, the component control 7 closes that part of the production casing or the sleeve control 7 moves the sleeve 5 to close the opening. Such closing of part of the production casing or opening can be performed from surface by communicating with the first communication module of that control. At a later stage, e.g. when planning other intervention services, the sleeve or component control can be released and retracted from the main production casing 2 or lateral production casing 81, providing full bore access of the casing, enabling access for all kinds of intervention tools. After performing the interventions, the completion system is re-completed by reinstalling the sleeve and/or component controls. So even though the completion system is intended for non-intervention wells, intervening the production casing is still possible. Furthermore, when having the sleeve control and/or the completion controls out of the well, the controls can be updated especially in relation to software and battery, but also in relation to other parts.

Figure 9:
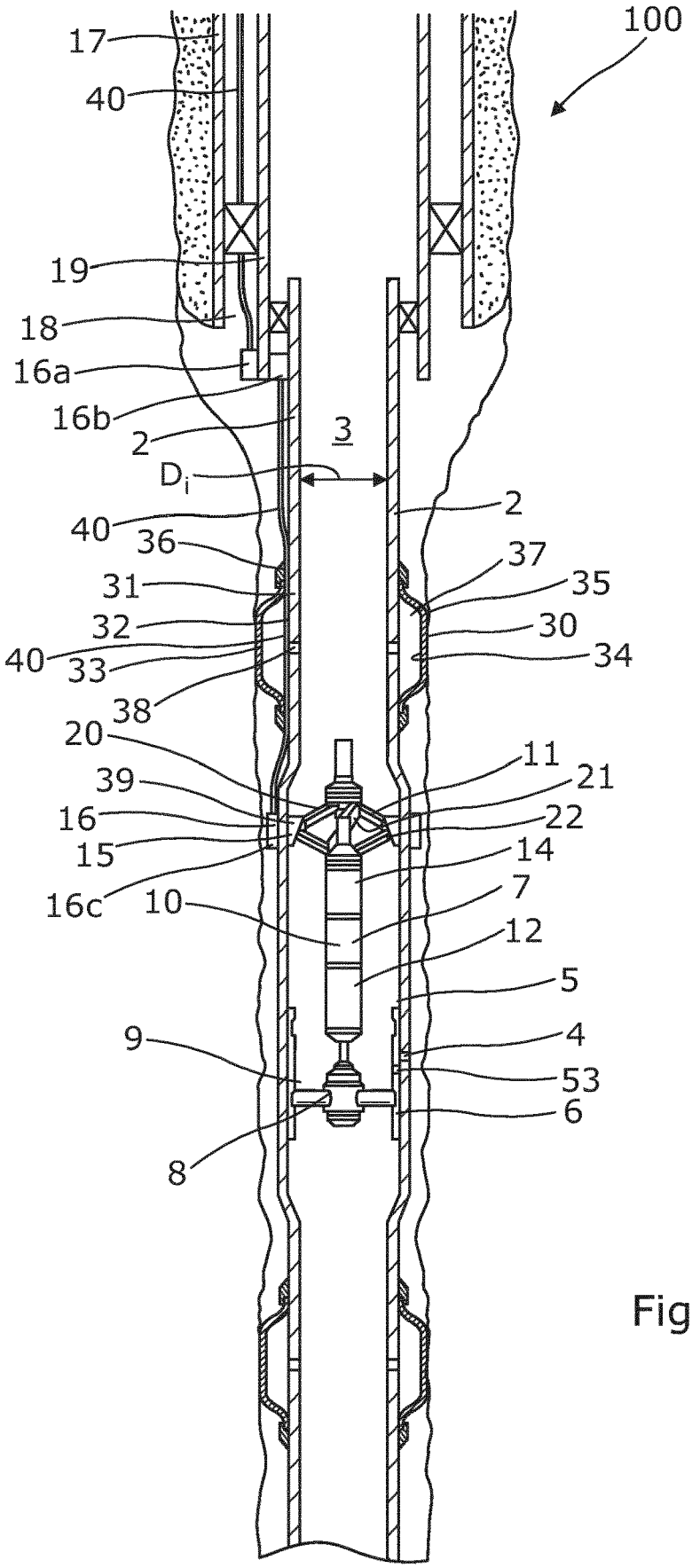
FIG. 9 shows a cross-sectional view of another downhole completion system having several communication units arranged down the well.

In FIG. 9, the downhole completion system 100 has a sleeve 5 movable by the sleeve control as in FIG. 2. The first communication module 15 of the sleeve control is arranged in the fixation unit 11 abutting the restriction 39 and the inner face of the casing 2. The second communication module comprises a first communication unit **16*a* arranged on an outer face of the intermediate casing and a second communication unit 16*b* arranged on an inner face of the intermediate casing. The first communication unit and the second communication unit are electrically connected via electromagnetic induction and transfer signals and electrical power between them through the intermediate casing 19. The second communication module 16 comprises a third communication unit 16*c* connected with the second communication unit 16*b* by means of wiring or an electrical conductor, such as a cable, a cord or a wire. The third communication unit 16*c* is arranged on the outer face of the production casing further down the well opposite the first communication module 15**. The third communication unit

16*c* of the second communication module 16 and first communication module 15 transfer signals and electrical power between them via electromagnetic induction through the production casing 2. The wiring 40 between the second communication unit 16*b* and the third communication unit 16*c* runs an annular barrier 30 in through one of the connection parts 51, connecting the expandable sleeve 33 with the tubular part 31, and past the space 37 and through the other connection part 51 further down the well, as illustrated in FIG. 11. The connection parts 51 may comprise connectors configured to connect to the wiring 40 and the connectors connect to an electrical conductor within the annular barrier in order that the wiring above and below is electrically connected through the connectors and the conductor. The wiring 40 may also extend through the annular barrier through a tube acting as a tunnel through the space between the expandable sleeve and the tubular part 31.

Figure 10:
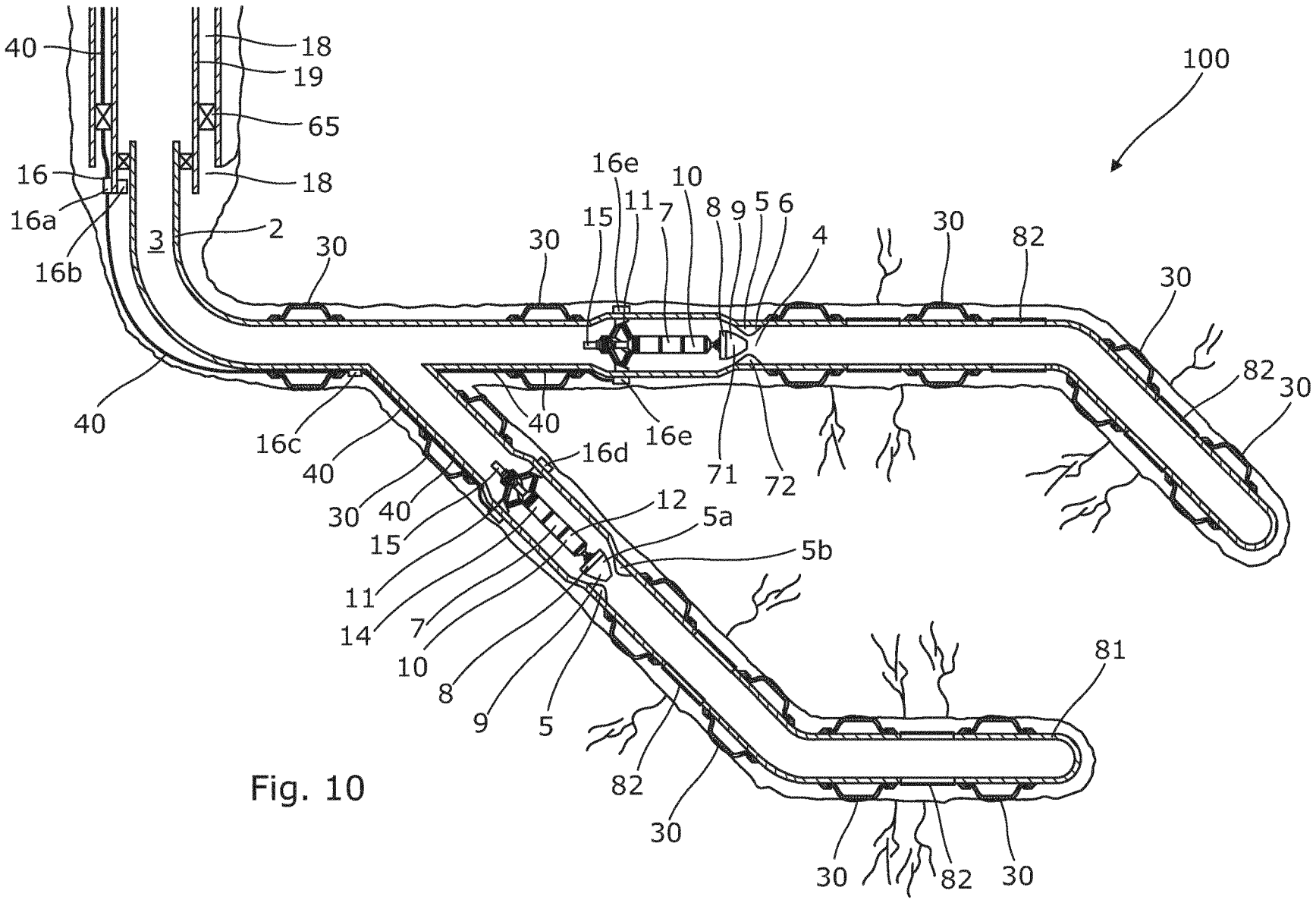
FIG. 10 shows a cross-sectional view of yet another downhole completion system having several communication units arranged down the well and in a lateral production casing.

In FIG. 10, the downhole completion system 100 comprises completion components 5 where a first part 5*a* of the completion component is the at least one member 9 engaging the profile 6 of a second part 5*b* of the completion component. Thus, the first part 5*a* of the completion component is arranged at the component control 7. The first communication module 15 of the component control 7 is arranged in the fixation unit 11 abutting the restriction 39 and the inner face of the casing 2. The second communication module 16 comprises a first communication unit 16*a* arranged on an outer face of the intermediate casing and a second communication unit 16*b* arranged on an inner face of the intermediate casing. The first communication unit 16*a* is electrically connected to surface via wiring 40 extending through the main barrier 65. The first communication unit 16*a* and the second communication unit 16*b* are electrically connected via electromagnetic induction and transfer signals and electrical power between them through the intermediate casing. The second communication module 16 comprises a third communication unit 16*c* connected with the second communication unit 16*b* by means of wiring or an electrical conductor, such as a cable, a cord or a wire. The third communication unit 16*c* is arranged on the outer face of the production casing further down the well but above the lateral production casing 81. The second communication module 16 comprises a fourth communication unit 16*d* arranged opposite the first communication module 15. The third and fourth communication units are electrically connected via wiring 40. The fourth communication unit 16*c* of the second communication module 16 and first communication module 15 transfer signals and electrical power between them via electromagnetic induction through the production casing 2. The third communication unit 16*c* is furthermore electrically connected with a fifth communication unit 16*e* arranged outside the main casing which is the production casing 2. The fifth communication unit 16*e* is arranged opposite a first communication module 15 of another component control 7 in the main casing and transfers signals and power by means of electromagnetic induction through the production casing 2. Both the wiring 40 between the second communication unit 16*b* and the third communication unit 16*c* and between the third communication unit 16*c* and the fourth communication unit 16*d* run past an annular barrier 30. The wiring 40 extends in through one of the connection parts 51 connecting the expandable sleeve 33 with the tubular part 31 and past the space 37 and through the other connection part 51 further down the well as illustrated in FIG. 11. The wiring 40 of FIG. 10 between the third communication unit 16*c* and the fifth communication unit 16*e* extends past the lateral production casing 81 on the outside of the main casing and through the annular barrier 30 arranged further down the main casing.

All the communication units, each comprises an inductive coupler for transferring power from one communication unit to another through the casing by means of electromagnetic induction. The casing may have non-magnetic sections opposite the communication units to optimise the transfer by electromagnetic induction.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing, a production casing, an intermediate casing, tubular part or well tubular structure is meant any kind of pipe, tubing, tubular, liner, string etc. fixedly installed downhole in relation to oil or natural gas production and through which the oil or gas flows.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole completion system arranged in a borehole, comprising:

a production casing having an axial extension, an inside, an inner diameter and an opening for providing fluid communication between the borehole and the inside, a sleeve or a completion component arranged at least partly movably along or rotatably within the axial extension, the sleeve or the completion component being arranged opposite the opening for opening, choking or closing the fluid communication, the sleeve having a profile facing the inside of the casing, and a sleeve control for moving the sleeve to open, choke or close the opening, wherein the sleeve control comprises:

a first part having at least one member engaging the profile, a second part having:

a fixation unit fixating the sleeve control in the casing, an actuator for moving the first part in relation to the second part, a power supply configured to supply power to the actuator, and a first communication module for receiving control signals from surface, wherein the downhole completion system further comprises a second communication module for communicating with the first communication module, where the second communication module is arranged on the outer face of the casing and that the sleeve control with the first communication module is arranged inside the casing.

2. A downhole completion system according to claim 1, wherein the second communication module comprises a first communication unit and a second communication unit.

3. A downhole completion system according to claim 2, wherein the first communication unit and the second communication unit are electrically connected via electromagnetic induction.

4. A downhole completion system according to claim 1, wherein a first part of the completion component is the at least one member engaging the profile of a second part of the completion component.

5. A downhole completion system according to claim 1, wherein the second communication module is arranged near a top of the borehole, submerged into an annulus between the production casing and a wall of the borehole or an intermediate casing, or connected to the production casing.

6. A downhole completion system according to claim 1, wherein the first and second communication modules communicate wirelessly by means of mud pulses, an electrical field, electromagnetic induction or acoustic waves.

7. A downhole completion system according to claim 6, wherein the power supply is rechargeable.

8. A downhole completion system according to claim 7, wherein the power supply is rechargeable and recharged by the first communication module converting the mud pulses, an electrical field or acoustic waves into electrical energy or by transferring electromagnetic induction.

9. A downhole completion system according to claim 1, wherein the fixation unit has fixation elements extending radially towards the production casing.

10. A downhole completion system according to claim 1, wherein the first communication module comprises a propeller in connection with a generator for recharging the power supply by converting rotational energy generated by fluid in the production casing to electrical energy.

11. A downhole completion system according to claim 1, wherein the actuator comprises an electrical motor powered by the power supply.

12. A downhole completion system according to claim 11, wherein the actuator further comprises an electrical motor powered by the power supply and a cylinder having a cylinder chamber in which a first end of a cylinder shaft is arranged, a plunger connected to the shaft divides the chamber into a first chamber part and a second chamber part, a second end of the cylinder shaft is connected with the first part, the actuator further comprising a pump providing pressurised fluid into one of the chamber parts for moving the cylinder shaft and the first part along the axial extension.

13. A downhole completion system according to claim 1, wherein the actuator comprises an electrical motor powered by the power supply and a gear arrangement driven by the motor for moving the first part.

14. A downhole completion system according to claim 13, wherein the gear arrangement is a worm drive providing an axial movement of the first part in relation to the second part.

15. A downhole completion system according to claim 13, wherein the gear arrangement comprises at least one gear wheel for rotating the first part in relation to the second part.

16. A downhole completion system according to claim 1, wherein the downhole completion system comprises a plurality of openings in the production casing, a plurality of sleeves arranged opposite the openings and a plurality of sleeve controls, each sleeve control being arranged opposite a sleeve for opening, choking or closing the fluid communication through the opening.

17. A downhole completion system according to claim 16, wherein the first communication modules of the sleeve controls can communicate with each other.

* * * * *